US005941343A

United States Patent [19]

Kelsey

[11] Patent Number: 5,941,343

[45] Date of Patent: Aug. 24, 1999

[54] LADDER SAFETY ACCESSORY

[76] Inventor: Dale Kelsey, 3333 Hargo Rd., Toledo, Ohio 43606

[21] Appl. No.: 09/089,426

[22] Filed: Jun. 3, 1998

[51] Int. Cl.[6] ..... E06C 7/18

[52] U.S. Cl. ..... 182/107; 182/214

[58] Field of Search ..... 182/106, 107, 182/214

[56] References Cited

U.S. PATENT DOCUMENTS

| | | | |
|---|---|---|---|
| D. 181,617 | 12/1957 | Allison | D15/8 |
| 3,059,721 | 10/1962 | Straw | 182/13 |
| 3,853,202 | 12/1974 | Jarboe | 182/108 |
| 4,179,011 | 12/1979 | Morawski | 182/45 |
| 4,369,860 | 1/1983 | Beane | 182/214 |
| 4,434,871 | 3/1984 | Niedworok | 182/198 |
| 4,444,291 | 4/1984 | McPherson | 182/214 |
| 4,548,293 | 10/1985 | Haab | 182/106 X |
| 4,600,079 | 7/1986 | McBride | 182/108 |
| 5,012,895 | 5/1991 | Santos | 182/204 |
| 5,242,031 | 9/1993 | Ashley | 182/214 |
| 5,333,323 | 8/1994 | Aymes | 4/496 |
| 5,341,899 | 8/1994 | Casamento | 182/107 X |
| 5,509,500 | 4/1996 | Delagera | 182/107 |
| 5,628,381 | 5/1997 | Markovich et al. | 182/107 |
| 5,743,356 | 4/1998 | Mitchell | 182/107 X |

OTHER PUBLICATIONS

Werner Corp., Climbing Products Catalog, 1996.
Louisville, "The Smart Choice in Ladders", 1996.
Louisville, Ladder Corp., Product Catalog, 1996.

*Primary Examiner*—Daniel P. Stodola
*Assistant Examiner*—Hugh B. Thompson
*Attorney, Agent, or Firm*—Fitzpatrick, Cella, Harper & Scinto

[57] ABSTRACT

A safety extension accessory for a ladder of the type having laterally spaced apart rails, interconnected by laterally extending rungs. The safety accessory includes a pair of handrails each having an upper portion and a lower portion, where each lower portion is affixed to the upper portion of the respective ladder rail. A non-skid base is provided on the lower portion of said handrails to engage the landing surface. The hand rails are spaced apart further than the ladder rails to permit easy entry to the landing surface through the hand rails.

12 Claims, 6 Drawing Sheets

FIG. 1
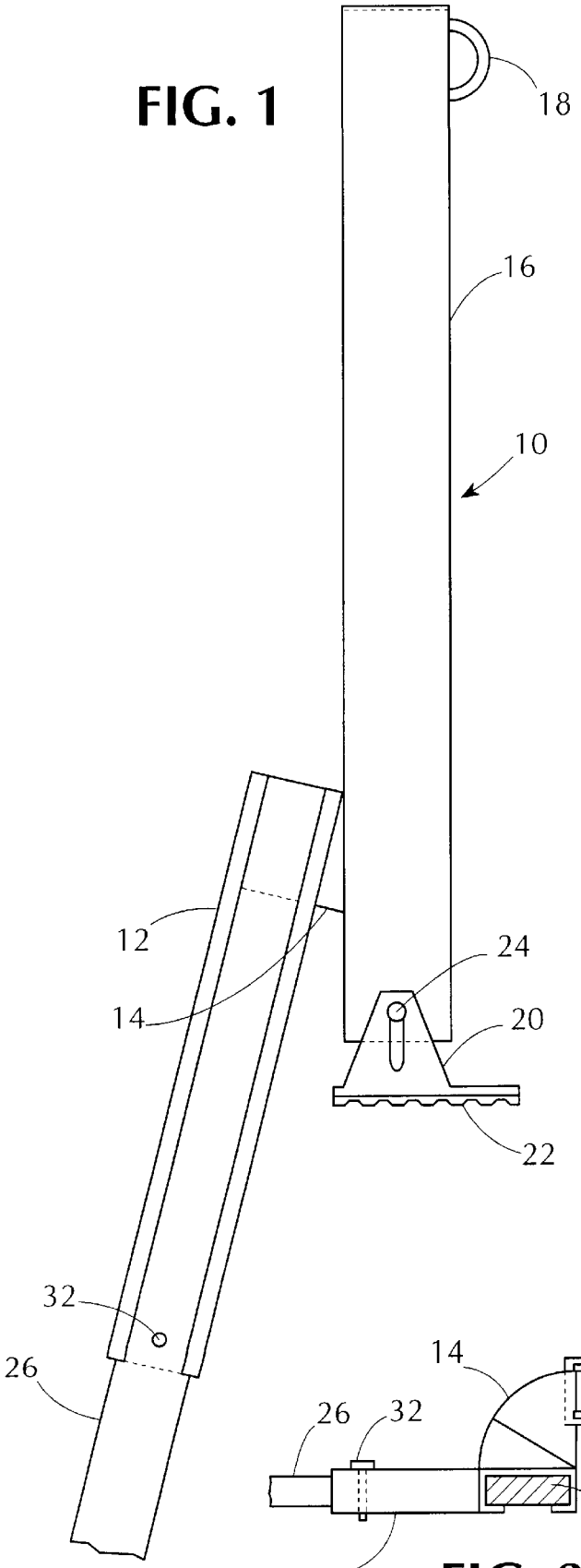
FIG. 2
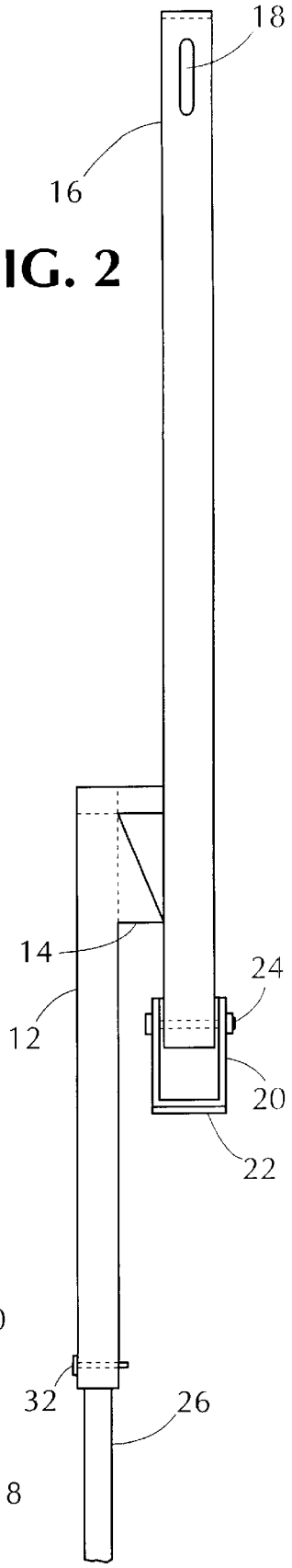
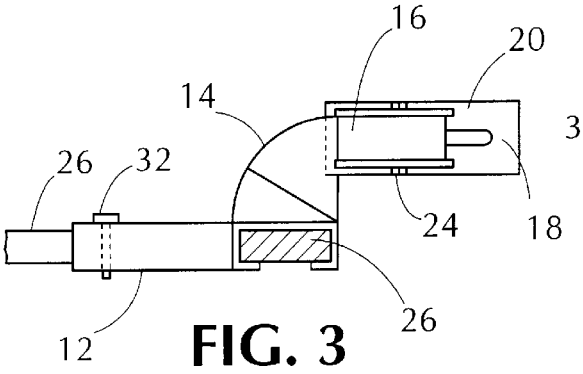
FIG. 3

LADDER SAFETY ACCESSORY

FIELD OF THE INVENTION

The invention relates to devices for enhancing the safety of ladders. Specifically, the invention relates to a ladder extension accessory designed to allow a person access to a roof of a building or other landing surface without having to step around a side rail of the ladder. Also, the invention relates to a detachable safety device designed to limit lateral slippage or similar movement of the upper end of a ladder.

BACKGROUND OF THE INVENTION

A ladder is most often used to reach high locations on buildings and other structures and particularly used to gain access to the roof of such structures. The typical ladder is made up of longitudinal rails with rungs disposed therebetween along the longitudinal length of the rails. Two or more ladder sections can be combined to form an extension ladder. An extension ladder enables a person to reach higher areas of a structure with a ladder that can be extended to nearly twice its length.

Thus, because of a ladder's design, the upper end is inherently prone to slipping and toppling over from even the slightest movement by one positioned on the upper part of the ladder. This is especially true when the angle of inclination is closer to vertical.

In addition, using a ladder to access a roof poses other problems. In order to gain access to the roof of a relatively low lying structure, a ladder is positioned on a side of the structure, usually with the top of the ladder adjacent to the roof. Typically, and in accordance with governmental safety regulations, the upper most part of the ladder must extend above the edge of the roof so that a person can adequately step onto the roof. Specifically, the Occupational Safety and Health Administration in 29 C.F.R. § 1926.1053(b)(1) specifies that where portable ladders are used for access to an upper landing surface, the ladder side rails shall extend at least three feet above the upper landing surface to which the ladder is used to gain access.

In order for a person to access the roof when exiting a typical ladder, he must step around one of the side rails of the ladder. This situation promotes the dangerous possibility of the ladder being pushed off the building by the force of a person's foot as he steps from the ladder. In addition, the safety of the person can be compromised at that moment, since the person may rely on the ladder rails to hang onto while stepping from the ladder onto the roof.

These conditions also occur when a person is merely using the ladder to reach high locations. For example, when using a ladder on a typical residential house, the upper most part of the ladder is typically leaned against the outer edge of the gutter. The contact area between the gutter and the ladder is extremely small since it is only the edge of the gutter that contacts the ladder rails. Due to the low coefficient of friction for the typically smooth metal gutter, especially at an edge, a very dangerous condition is created. Any slight lateral force can cause the ladder to slide across the gutter and even topple over. This condition is not unique to gutters on residential homes. It can occur in any circumstance where the ladder is leaned against a metal edge or other material with a low coefficient of friction.

SUMMARY OF THE INVENTION

It is an object of the present invention to provide an extension accessory for a ladder to provide a safe way of accessing the roof of a structure.

It is also an object of the present invention to provide a non-skid brace for a ladder to provide stability to the ladder on edge surfaces.

It is another object of the present invention to provide a ladder safety apparatus that is inexpensive to produce and implement.

It is another object of the present invention to provide a ladder safety apparatus that is reliable for continued, repetitive use.

In one aspect of the current invention, an extension accessory for a ladder is provided. The ladder is of the type that includes a pair of laterally spaced apart rails, each having an upper portion and a lower portion. The rails are interconnected by laterally extending rungs. The accessory includes a pair of handrails each having an upper portion and a lower portion, where each lower portion is attached to the upper portion of a respective ladder rail. The spacing between the handrails is greater than the ladder width to allow direct passage therebetween to avoid the necessity of stepping sideways.

In another aspect of the present invention, a stabilizer brace for a ladder is provided. The ladder is of the type having a plurality of laterally extending rungs, where the stabilizer brace is removably affixed to at least one of the rungs of the ladder. The brace includes a bracket having a first side facing away from the ladder and a second side having a portion for receiving a rung of the ladder. The first side of the brace includes a non-skid surface.

In still another aspect of the present invention, a stabilizer brace for a ladder is provided. Again, the ladder is of the type having a pair of laterally spaced apart rails interconnected by laterally extending rungs. The brace is removably affixed to at least one of the rungs and includes a bracket formed to encompass a rail of the ladder. The bracket also includes two parallel sides separated by a third side, and an opening for receiving a rung of the ladder disposed on one of the parallel sides. The third side includes a non-skid surface.

BRIEF DESCRIPTION OF THE DRAWINGS

FIG. 1 is a side elevational view of a safety extension accessory for a ladder according to a first embodiment of the present invention.

FIG. 2 is a front elevational view of the safety extension accessory for a ladder according to a first embodiment of the present invention.

FIG. 3 is a top plan view of the safety extension accessory for a ladder according to a first embodiment of the present invention.

DESCRIPTION OF THE PREFERRED EMBODIMENTS

Figure 4:
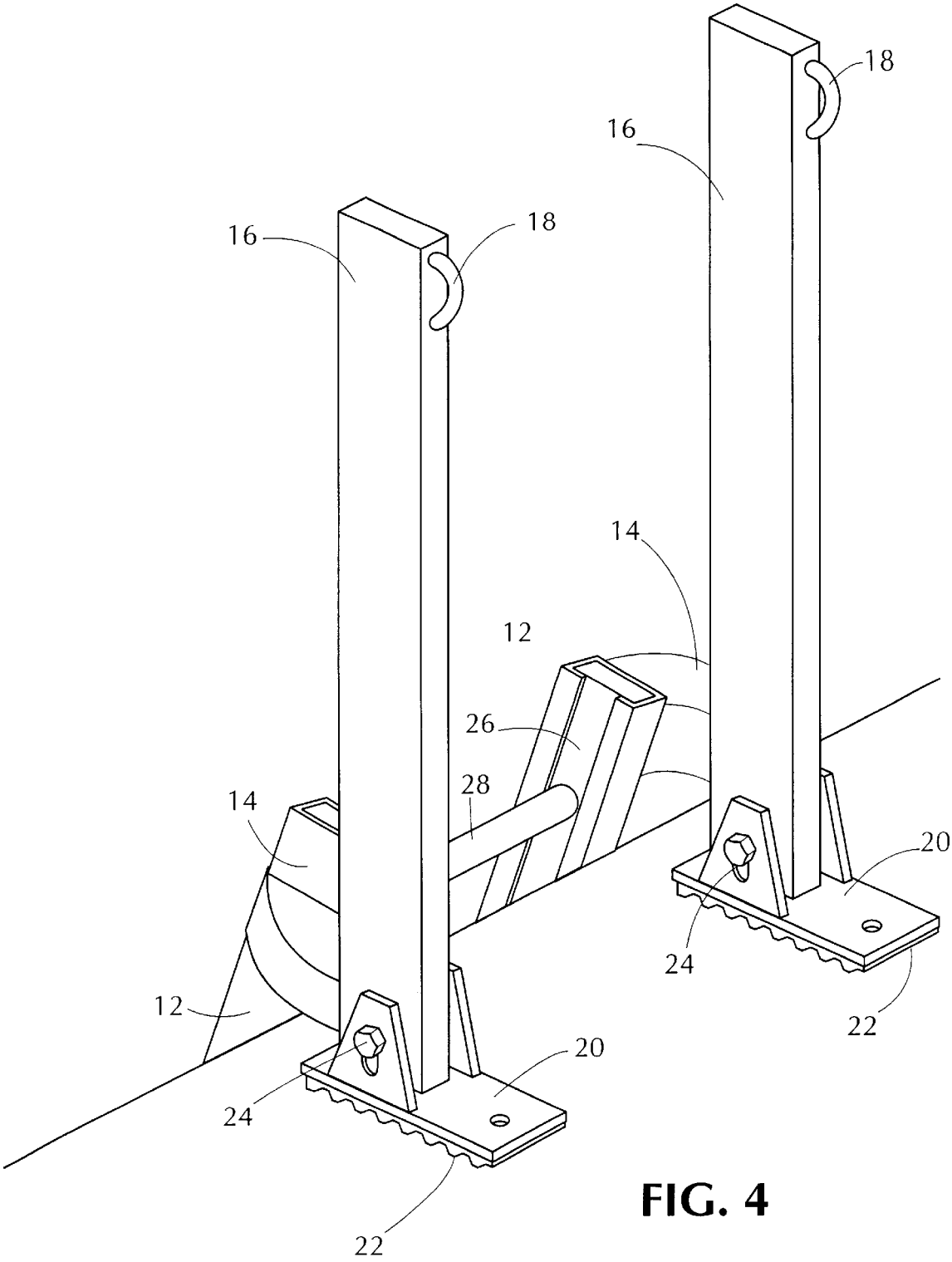
FIG. 4 is a perspective view of the safety extension accessory for a ladder according to a first embodiment of the present invention showing the ladder in use on a flat landing surface.
Figure 7:
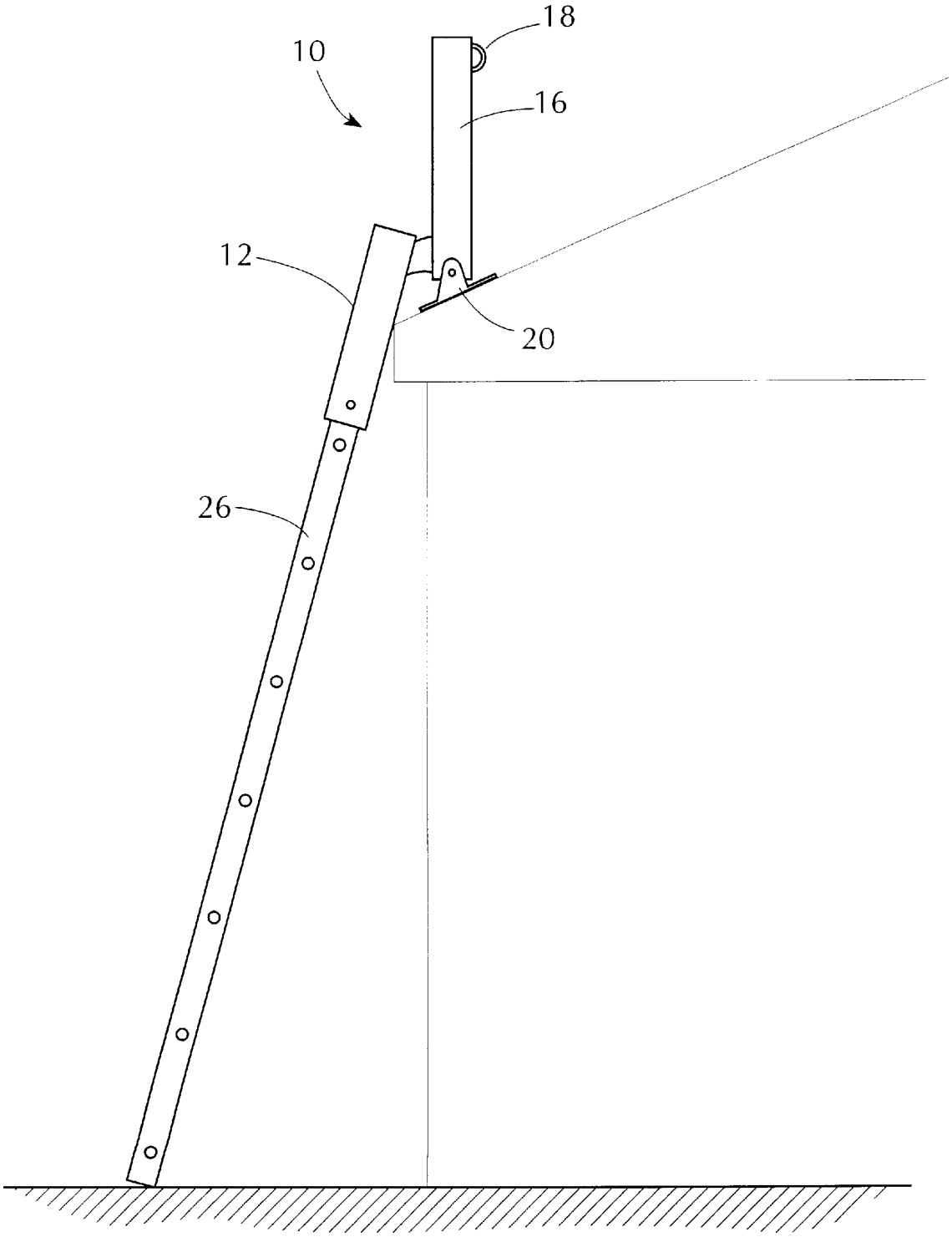
FIG. 7 is a view showing the use of the safety extension accessory on a sloped landing surface.

A first embodiment of the present invention is illustrated in FIGS. 1–3, which show an extension accessory for a ladder, used to access roofs of building structures, as shown in FIGS. 4 and 7. The accessory is not limited to use solely with flat roof structures as FIG. 7 illustrates the present invention being used on a residential home with a sloped roof.

As shown in FIGS. 1 to 3, each extension accessory includes a sleeve member 12, connected by a curved lateral extension member 14 to a handrail member 16. The handrail 16 includes a securing loop 18 that may be used to secure a warning line system, if desired, to the ladder and accessory assembly. At the base of each handrail 16 is a self-adjusting shoe 20 attached by fastener 24, to permit adjustment to the inclination of the surface on which the extension accessory sits. The bottom surface of pad 22 may be a non-skid material such as rubber or the like with a roughened or patterned tread or any suitable pattern which resists movement. As shown in the perspective view in FIG. 4, the pivoting, self-adjusting shoe 20 provides a contact area on the surface of the structure that is much greater than the contact area if the ladder was simply leaned up against the structure. This results in an assembly that provides much more stability as the increased contact area provides much more friction to keep the ladder stable than that of an ordinary ladder leaning against the edge of a roof.

Although the various members are preferably integrally secured, each member may be removably affixed to one another by removable bolts, or other fastening means that one of ordinary skill in the art would appreciate.

The handrail 16, lateral extension member 14 and sleeve member 12 can be made of any material that can maintain adequate strength. These materials include aluminum, steel, metal alloys, fiberglass, and carbon fiber materials.

The cross section of each sleeve member 12 is constructed in a "U" shape, forming a channel into which the upper part of a ladder rail 26 can be received and held. As illustrated in FIG. 4, the design of the sleeve member 12 channel is such that the end of a ladder rail can be easily slid and secured into the channel. In addition to the design of the sleeve member 12 described above, the design can be of the type that includes a simple structurally strong member that is clamped to the outer portions of each ladder rail by an external clamping member or suitable fastener.

Each sleeve member 12 is locked onto the respective ladder rail 26 by a locking pin 32, located at the lower portion of each sleeve member 12. The locking pin 32 includes, a strap member 34, appropriately engaged about the ladder rail to secure the sleeve 12 to the ladder. The locking pin 32 is received by a first opening 13, located in the lower portion of the sleeve member 12.

The locking pin 32 secures the sleeve 12 to the ladder rail 26 in the following manner. Prior to using the extension accessory for the first time, the user first removes the locking pin 32 from the sleeve 12, and then slides sleeve member 12 over ladder rail 26, unit the top edge of the ladder rail 26 abuts the top end 11 of sleeve 12.

Figure 5:
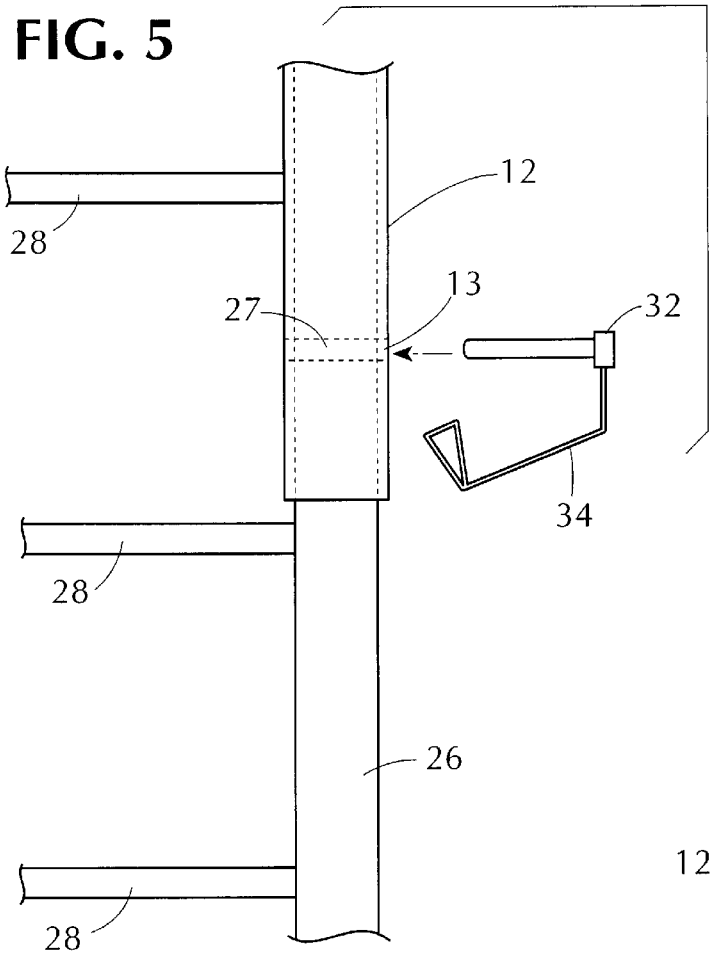
FIG. 5 is a side elevational view showing a partial sectional view of the safety extension accessory according to a first embodiment of the present invention illustrating a means for locking the safety extension accessory onto a ladder.

Using the first opening 13 as a guide, the user then drills a second opening 27 (see FIG. 5) through the ladder rail at a diameter large enough to accommodate the locking pin 32. Upon completion, the user then inserts the locking pin 32 into the first opening 13, and continues to push the pin 32 through the second opening, until the end locking pin 32 protrudes a sufficient distance out from the ladder rail 26, so that the strap member 34 can be swiveled around so that the end of the strap member can be placed over the end of the locking pin 32. The extension accessory is now locked onto the end of the ladder rail.

Figure 6:
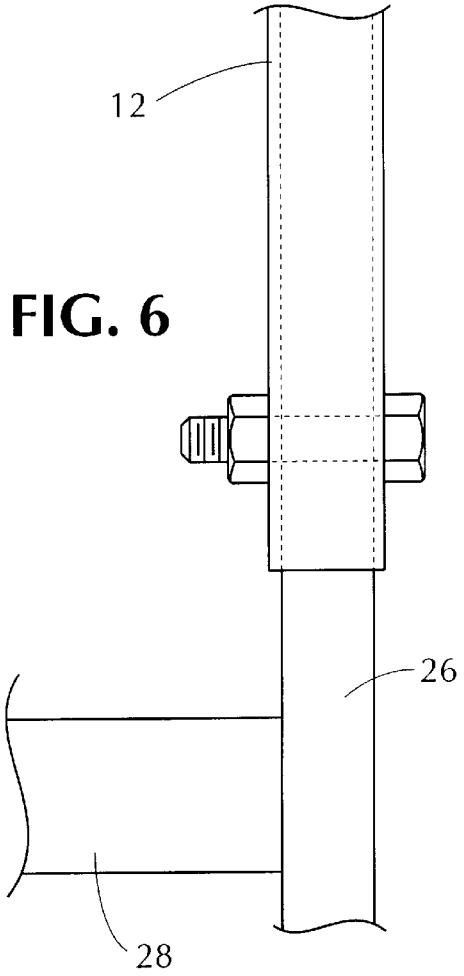
FIG. 6 is a side elevational view of the safety extension accessory according to a first embodiment of the present invention illustrating an alternative fastening means for locking the accessory to a ladder.

The safety extension accessory of the present invention can be affixed to a ladder in any other convenient manner. As shown in FIG. 6, for example, the accessory can be bolted to a ladder's rails by threaded bolt and nut, or by threaded clamps as is evident to one of ordinary skill in the art. All that is necessary is that the means to fasten the safety extension is secure and does not result in movement of the safety extension along the side rails.

The present invention is not limited solely to an extension accessory having sleeve members 12. The handrails 16 in conjunction with lateral members 14 could be affixed to the upper portion of a ladder through fastening means consisting of several heavy duty threaded fasteners, pins, or other fastening devices as is well understood by one of ordinary skill in the art.

It can be appreciated that the lateral safety extension accessory thus increases the distance between the ladder rails. Typical ladder rails are not designed to be walked through. Hence, the ladder rails have been typically been designed to be only twelve to sixteen inches apart. This distance is normally insufficient for an adult person to fit conveniently without difficulty within the ladder rails. Thus, the lateral extension members provide an increase to an acceptable distance for a person to exit the ladder and "walk" through the hand rails 16.

A novel feature of the extension assembly is that it allows a person to access the roof of a structure without having to step around one or the other rails of a ladder. The person simply climbs the ladder, and upon reaching the top, simply grabs hold onto one or both of the handrails to complete entry onto the roof or landing. Because the non-skid surface of pad 22 provides a secure surface contact, the ladder will withstand significant lateral force without slippage, thus, increasing the safety of the ladder.

Figure 8:
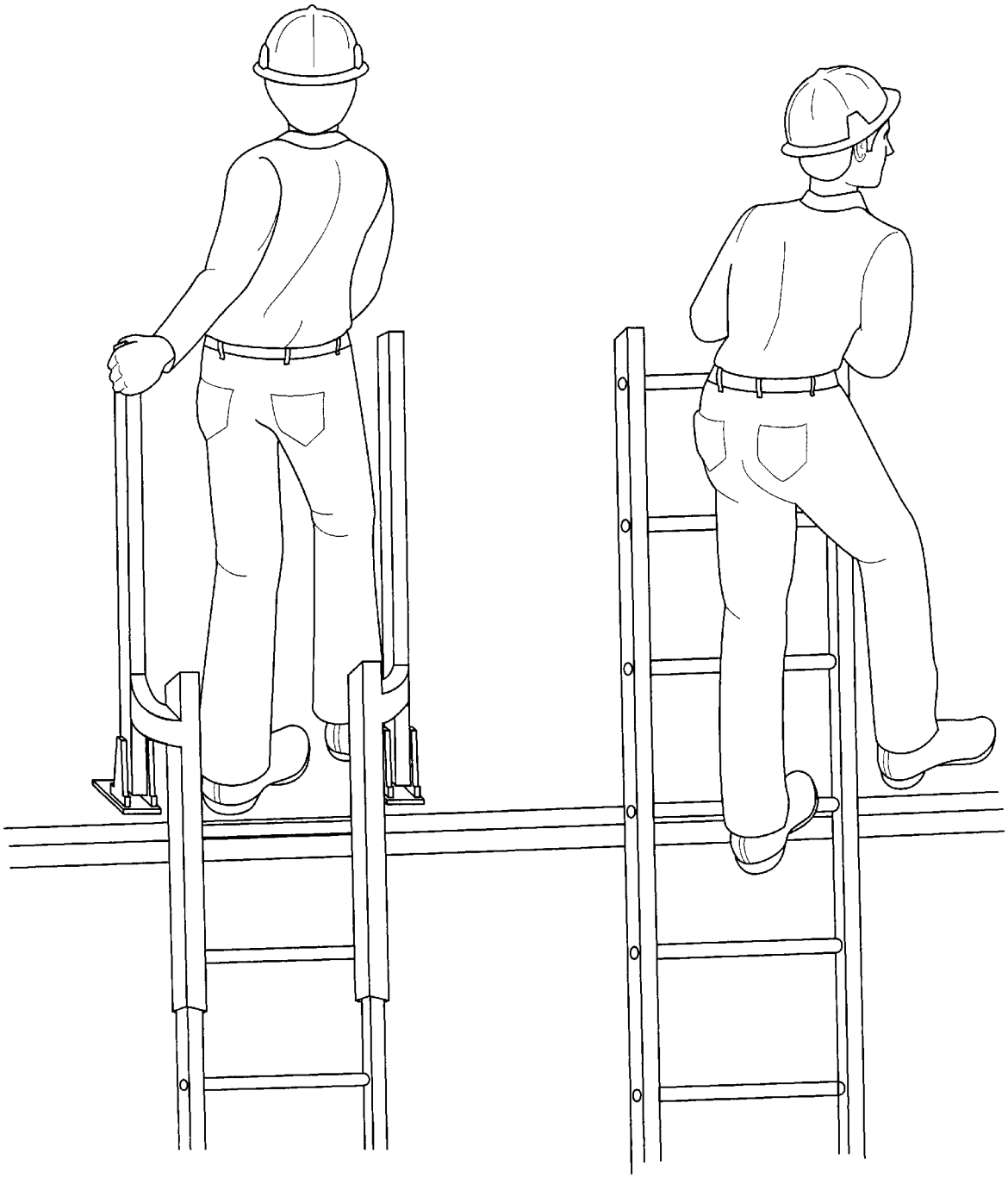
FIG. 8 is a view illustrating the use of the extension accessory for a ladder according to the present invention illustrating a person exiting a ladder having the extension accessory. The figure also illustrates a person exiting a ladder not having the extension accessory.

As shown in FIG. 8, illustrating a comparison between an ordinary ladder for accessing the roof and through the use of the extension accessory on an ordinary ladder according to the present invention, exiting the ordinary ladder promotes several dangerous conditions. First, when the person exits the ladder, he ordinarily exerts a lateral force on the ladder which may push the ladder off the structure. This is dangerous since the ladder can cause injury to those below, as well as to other property.

Second, the person entering the roof or landing can easily fall when exiting the ladder either from misjudging the step he must take when going around one of the ladder rails, or by exerting a strong enough lateral force on the ladder to cause the ladder to slip off the structure. In addition, when the angle of inclination is small so that the ladder is very near to vertical, the side-stepping action can be very dangerous as the normal tendency is to grasp and hold the support which may cause the ladder to move.

Ladders are often used to gain access to heights without gaining access to a roof or landing surface. For example, in working on a building or other structure at an elevated height to paint or do other work on a wall of the structure, a user will often reach to the side to maximize the area being worked on without having to move the ladder. This results in a lateral force being imposed on the ladder which, in some instances, can result in the ladder sliding from its fixed location resulting in the user falling. Thus, there is a need for a ladder safety accessory to provide for increased stability and positive securement of a ladder to the work location.

Figure 9:
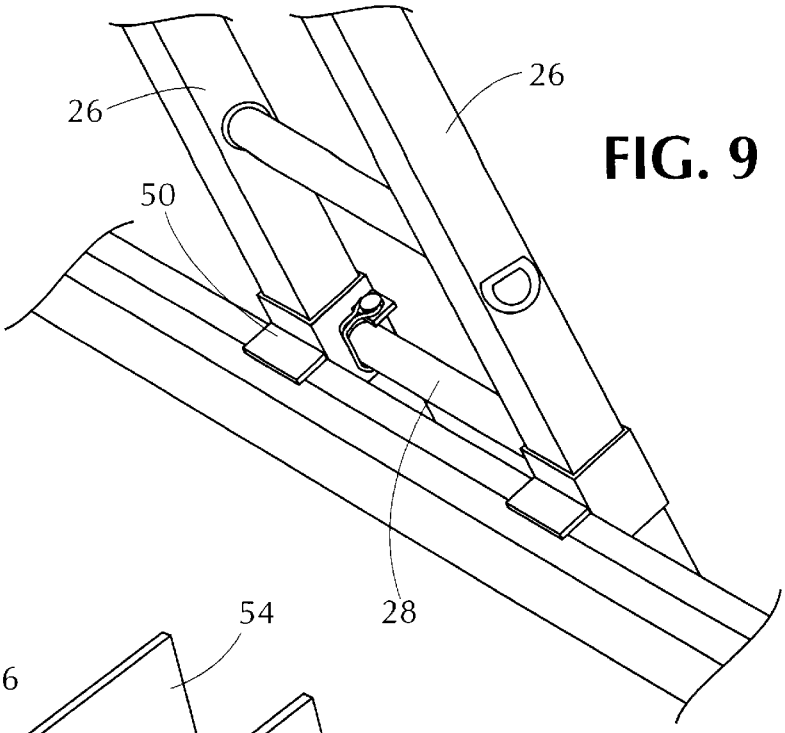
FIG. 9 is a perspective view showing the non-skid brace of a second embodiment of the present invention.
Figure 10:
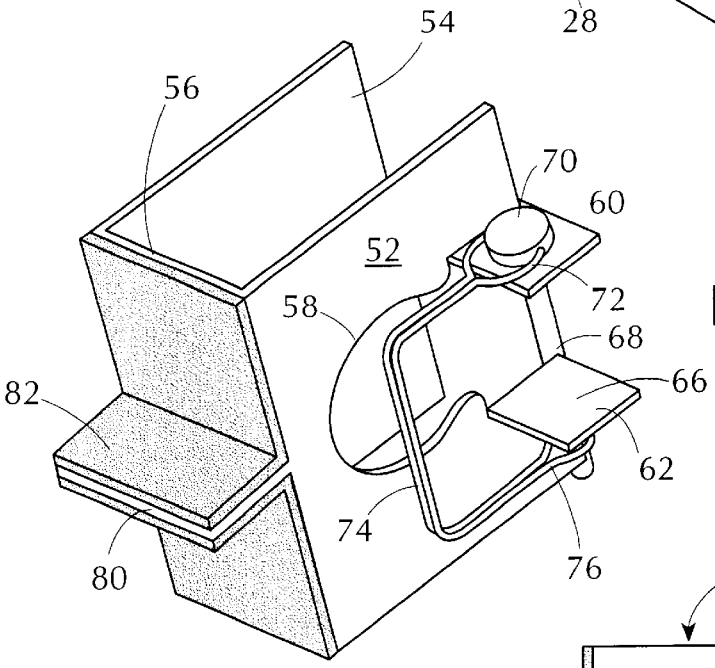
FIG. 10 is a perspective view of a non-skid brace for a ladder according to a second embodiment of the present invention.
Figure 11:
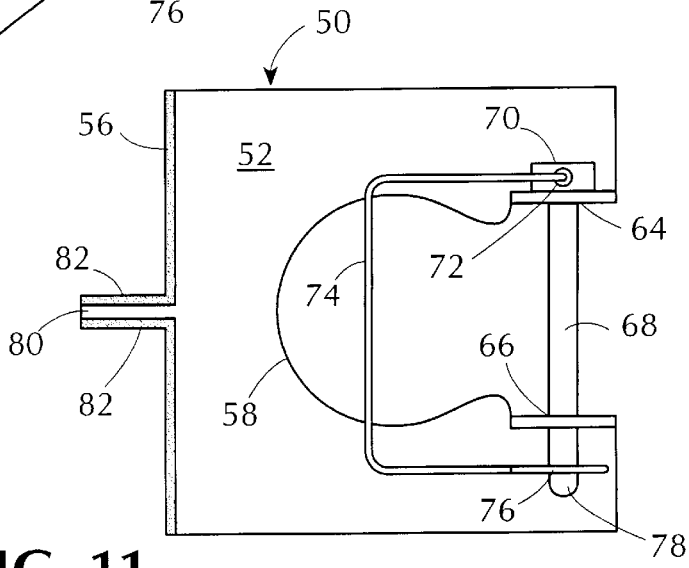
FIG. 11 is a side view of a non-skid brace for a ladder according to a second embodiment of the present invention.

A second embodiment of the present invention is illustrated in FIGS. 9–11. The second embodiment is directed to a non-skid brace that provides a quick, easy and effective device providing increased stability to the top portion of a ladder. This embodiment can be used with the safety extension to provide additional ladder securement or could be used alone with a standard ladder. Unlike some prior art devices used to help stabilize the top of a ladder, the non-skid brace of the present invention can be attached to the ladder on the ground level. The ladder can then be placed in position against an edge of a structure when the ladder is placed against the building by someone on the ground. In addition, the braces are designed so that it can fit either the left or right side of a ladder rung.

The non-skid brace 50 includes a U-shaped bracket having side walls 52 and 54 and end wall 56. One wall 52 includes an accurately shaped ladder rung receiving opening 58 to receive a ladder rung 28 of a ladder. An upper flange 60 and a lower flange 62 extend outwardly from side wall 52 at each side of the receiving opening 58.

Each flange includes a through bore 64 and 66, respectively therethrough to receive a pin 68. Pin 68 has a head 70 at one end to receive one end 72 of a strap clamp member 74. Clamp 74 is also U-shaped and is preferably made of two metallic members having a loop 76 at its other end. Clamp 74 is sufficiently resilient to permit spring-like movement so that loop 76 can be engaged about end 78 of pin 68 which extends beyond flange 62, as seen in FIG. 10. The strap clamp 74 can also be of a strong elastomeric type material.

End wall 56 is provided with an outwardly extending flange 80 in mid position of wall 56. A non-skid surface material 82, rubber or the like or plastic having abrasive material embedded therein, is provided over the exterior surface of wall 56 and flange 80.

The non-skid brace is installed on a ladder in the following manner. A pair of the braces are affixed to a rung of the ladder which will rest against the building structure, while the ladder is at ground level. Pin 68 is removed and the brace positioned to encompass both the ladder rail and a ladder rung. Pin 68 is reinserted and clamp strap member 74 appropriately engaged about the ladder rung to secure the non-skid brace to the ladder. The ladder rung is usually amongst the first few rungs of the ladder from the top. Once the braces are secured around the rungs of the ladder with the locking pins, the ladder is then leaned against the structure, with the bottom surface of flange 80 and the lower wall surface 56 of the non-skid brace resting on respective edge surfaces of an upper area on a structure. The bottom of the ladder is then logically positioned at an appropriate location for insuring that a sufficient frictional force is generated between the nonskid brace surfaces and the edge of the structure. Thus, the ladder is now in a stable condition.

This non-skid surface material 82, provides increased contact area and with a high coefficient of friction which in turn provides more frictional resistance to prevent unwanted lateral movement of the upper part of the ladder. Thus, the non-skid brace provides increased safety and stability for a user.

It is thus seen that the present invention provides a safety accessory for a ladder which permits safer egress from a ladder to a roof or other landing surface. The safety accessory provides a wider opening to permit ready access to the landing surface by direct passage through the opening and obviates the need for a user to side step the ladder to step on to the landing surface. In addition, a safety accessory is provided which secures a ladder to a roof surface in a positive manner to preclude movement of the ladder away from the roof surface while the ladder is in use.

What is claimed is:

1. A safety accessory for a ladder used to gain access to an elevated surface to be accessed by placing said ladder at an inclined position, said ladder having rails interconnected by spaced rungs wherein said rails are spaced part by a fixed dimension, said safety accessory comprising:

a pair of separate ladder rail engaging members configured to releasably and slidably but securely receive an upper end of respective ladder rail each of said ladder rail engaging members having an enclosed perimeter except for a slot smaller in width than the enclosed perimeter, said slot extending along the longitudinal axis of said ladder rail engaging members, a pair of lateral displacement members each attached at one end to an upper portion of a respective ladder rail engaging member, each said lateral displacement members projecting laterally outwardly from each said ladder rail engaging member, a pair of rail members each attached at a lower portion thereof to the other end of a respective lateral displacement member so as to establish a relationship with said ladder rail engaging members wherein said lateral displacement members position said rail members in a position laterally outwardly from said ladder rail engaging members, wherein when a pair of said safety accessories are secured to the upper ends of a ladder said rail members provide an opening therebetween which is greater than the opening between the ladder rails upon which said safety accessory is engaged to permit ready entry from said ladder through said accessory rail members.

2. The safety accessory as defined in claim 1 wherein each said accessory rail members includes on a lower surface thereof a surface contact member adapted to contact a surface of the elevated location to which access is desired.

3. The safety accessory as defined in claim 2 wherein said surface contact member has a high coefficient of friction.

4. The safety accessory as defined in claim 2 wherein said surface contact Member is pivotally secured to a lower end of said accessory rails to accommodate a wide range of angles of inclination of said surface to be accessed.

5. The safety accessory as defined in claim 1 including a securing member to releasably and securely engage said accessory to upper ends of said ladder rails.

6. A safety accessory in combination with a ladder having a pair of laterally spaced apart rails, said rails being interconnected by a plurality of spaced apart rungs with said rungs spacing said ladder rails by a fixed dimension, said safety accessory comprising a pair of ladder rail engaging members to releasably but securely receive an upper end of a respective ladder rail, a pair of lateral displacement members each attached at one end to an upper portion of respective ladder rail engaging member, each said lateral displacement members projecting laterally outwardly from each said ladder rail engaging members and said ladder rails, said ladder rail engaging members having an interior surface which is essentially complimentary in shape to the shape of said ladder rails so that said ladder rail engaging members fit over and slidably receive the upper ends of said ladder rails, a pair of rail members each attached at a lower portion thereof to the other end of a respective lateral displacement member so as to establish a relationship with said ladder rail engaging members and said ladder rails wherein said accessory rail members are each disposed laterally outwardly of a respective ladder rail to define an opening therebetween which is greater than the opening defined by said ladder rails to permit ready entry to a structure directly through said accessory rails.

7. The combination as defined in claim 6 wherein each said accessory rail members includes on a lower surface thereof a surface contact member to contact the surface of an elevated location to which access is desired.

8. The combination as defined in claim 7 wherein said surface contact member has a high coefficient of friction.

9. The combination as defined in claim 6 wherein said surface contact member is pivotally secured to a lower end of said accessory rail to accommodate a wide range of angles of inclination of said surface to be accessed.

10. The combination as defined in claim 6 wherein said ladder rail engaging members are secured to said ladder rails by threaded fasteners.

11. The combination as defined in claim 6 wherein said ladder rail engaging members are secured to said ladder rails by a locking pin member disposed through an opening in said ladder rail engaging members and an opening in said ladder rails.

12. The combination as defined in claim 6 wherein said ladder rail engaging members are secured to said ladder by a clamp member operatively engaged with a portion of said ladder engaging members and a portion of said ladder.

* * * * *